US005146828A

United States Patent [19]

Huang et al.

[11] Patent Number: 5,146,828

[45] Date of Patent: Sep. 15, 1992

[54] WRAP FILM CUTTER

[76] Inventors: Hong-Yuan Huang; Kuo-Feng Huang, both of No. 148, Jeng Yih North Road, San Chung City, Taipei Hsien, Taiwan

[21] Appl. No.: 677,562

[22] Filed: Mar. 29, 1991

[51] Int. Cl.[5] ..... B26D 1/02; B65H 35/06

[52] U.S. Cl. ..... 83/570; 83/588; 83/627; 83/649; 225/43

[58] Field of Search ..... 83/570, 589, 610, 588, 83/649, 856, 175, 614, 620, 627; 225/21, 90, 43

[56] References Cited

U.S. PATENT DOCUMENTS

| | | | |
|---|---|---|---|
| 833,470 | 10/1906 | Lipowsky | 83/570 |
| 3,166,224 | 1/1965 | Waltz | 225/90 |
| 3,228,578 | 1/1966 | Waltz | 225/90 |
| 3,311,278 | 3/1967 | Brandon | 83/570 |
| 3,752,725 | 8/1973 | Freeman | 83/588 |
| 4,040,319 | 8/1977 | Taniyama | 83/588 |
| 4,196,647 | 4/1980 | Fish | 83/649 |
| 4,417,495 | 11/1983 | Gordon et al. | 83/649 |

*Primary Examiner*—Hien H. Phan

*Attorney, Agent, or Firm*—Bacon & Thomas

[57] ABSTRACT

A wrap film cutter including a bar shaped housing and a lid as the main body; a double tiered protrusion on the front edge of the lid; a stuck out shaft attached to the end of the protrusion; a trough on the front edge of the housing; an indented cutting set installed in the trough. The hollow portion of the bar shaped housing is for the installation of the wrap film. With this device the film wil be cut by the length needed through an easy and quick pushing motion onto the lid. This way can save the time and energy and meanwhile, keep film in tidy shape.

8 Claims, 3 Drawing Sheets

WRAP FILM CUTTER

BACKGROUND OF THE INVENTION

1. Field of the Invention

The present invention generally involves the field of technology concerning wrap film cutters. More particularly, relates to a creative and improved wrap film cutter that can cut the wrap film easily and smoothly by the length needed through a light pressing motion onto the lid.

2. Discussion of Prior Art

Conventional wrap film sold in the market has a saw attatched and exposed on the package to cut the film by the length needed, but this kind of cutting method needs both hands to coordinate to complete with tearing motion. The unhandy cutting always causes the floppy film to be twisted to a mass in tearing. Besides, the exposed saw on the package could hurt the user if not carefully, so it is somehow dangerous.

Another conventional way to cut the wrap film is by moving a blade on the cutter. The sharp blade may cut the film smoothly and improve the problem of the film being twisted to a mass in tearing. But, since in this way the blade must be moved through a full span, it won't be convenient to the user if he needs to hold a heavy utensil with one hand and do a full span cutting motion with another hand at the same time. Also, since his hands can't keep in balance and steady the film is often twisted to a mass by the moving blade. It still causes inconvenience for use.

SUMMARY OF THE INVENTION

In view of the problems and inconveniences of various conventional wrap film cutters, the present invention is to provide a wrap film cutter with creative design. With the present invention, the people may just use a light pressing motion by the fingers to cut the film easily, quickly and smoothly by the length needed. Since no big motion of tearing or blade moving is needed, it can save the time and energy. It's safe for use and keeps the film in tidy shape as well.

The major feature of the present invention is to provide a wrap film cutter with the design of the hidden cutting set in the main body of the cutter. The cutting set can cut the film quickly and smoothly by the length needed through sequential motions of piercing and cutting.

Another feature of the present invention is to provide a wrap film cutter with the design of the double tiered protrusion on the front edge of the lid. By the light pressing motion onto the lid, the double tiered protrusion will push the the film into the trough which is on the front edge of the main body. And the hidden cutting set installed in the trough will complete the the cutting motion by moving in a very short distance. So it has the qualities of security and efficiency.

BRIEF DESCRIPTION OF THE DRAWINGS

The above and other objects, features and advantages of the present invention can be achieved by the embodiment of the invention as described in detail hereinafter, accompaning drawings, in which like reference numerals represent similar parts throughout, and wherein.

DETAILED DESCRIPTION OF THE PREFERRED EMBODIMENTS

Figure 1:
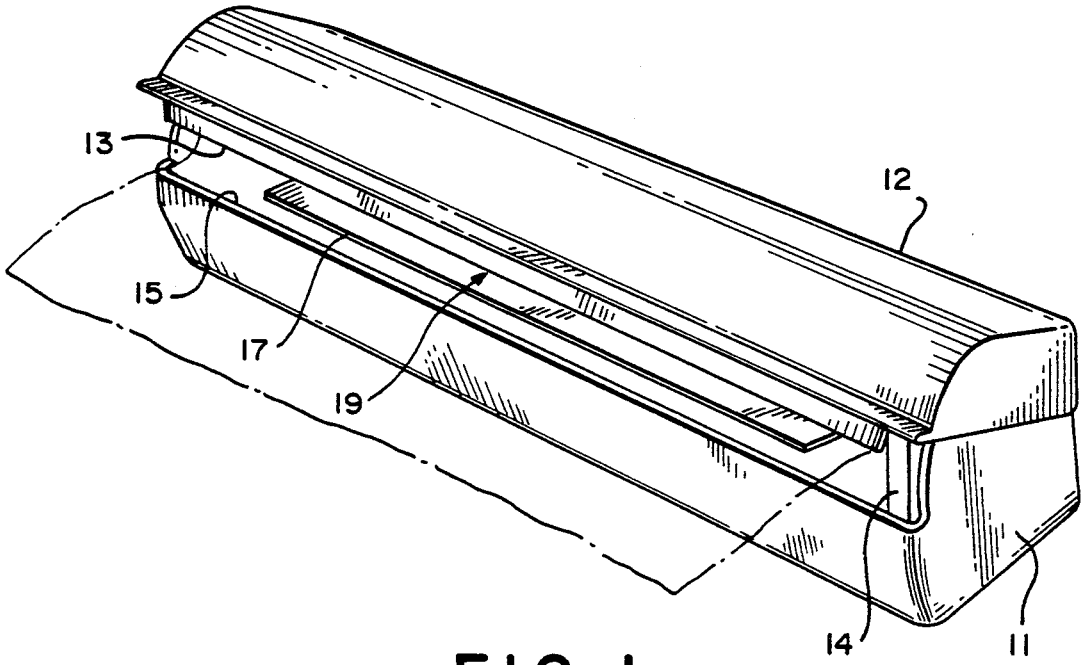
FIG. 1 is a perspective view of a wrap film cutter according to a preferred embodiment of the invention.

As shown in the attached figures, the present invention of wrap film cutter includes: a main body comprising a bar shaped elongate housing 11 and a lid 12; a double tiered protrusion 13 positioned on the front edge of the lid 12; a shaft 14 with a declined pane on the forward end, attached to the end of the double tiered protrusion 13; a trough 15 positioned on the front edge of the housing 11; a hidden cutting set 16 installed in the trough (see FIG. 2), of which the movement within the trough being controlled by the pressing of the shaft 14 on the front edge of the lid; and a lifting bar 17 above the trough 15 connected to the housing 11.

Figure 2:
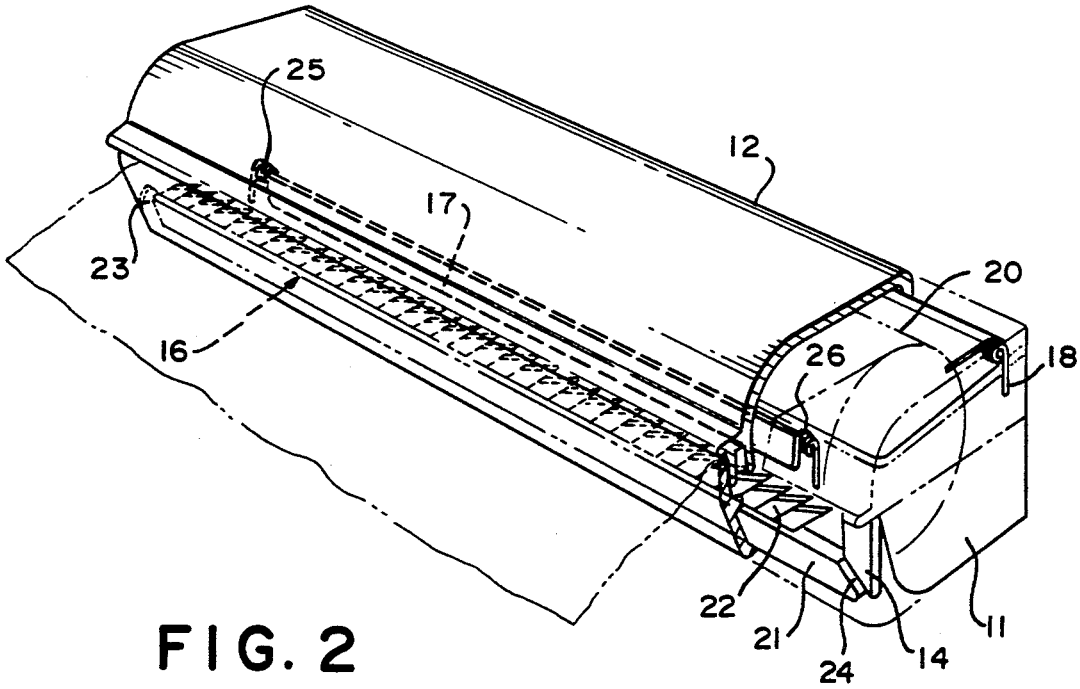
FIG. 2 showing the structure of the wrap film cutter of FIG. 1, in which the lid is partial dissected to show the configuration of the wrap film, the double tiered protrusion on the front edge of the lid and the hidden cutting set.
Figure 4:
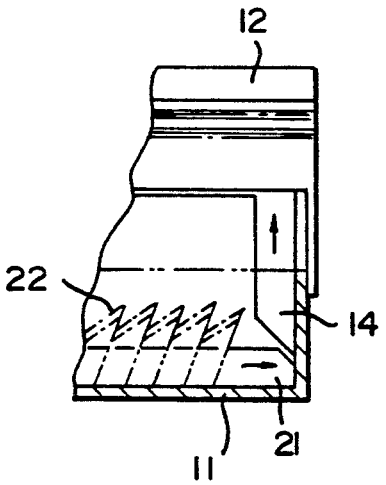
FIG. 4 is the front view of FIG. 3, showing the position of the hidden cutting set at the time the lid is not pressed yet.
Figure 3:
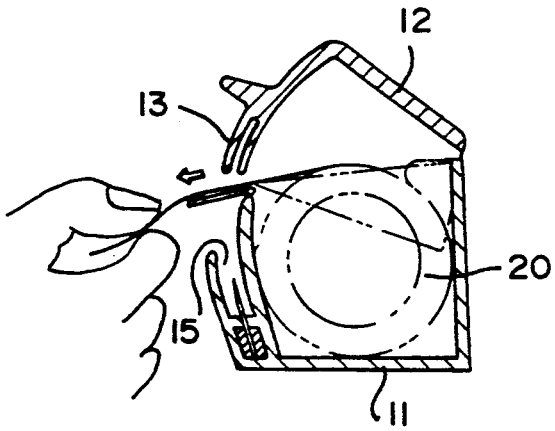
FIG. 3 is a cross-sectional view of the wrap film cutter of FIG. 1, in which the lid is not pressed yet.
Figure 6:
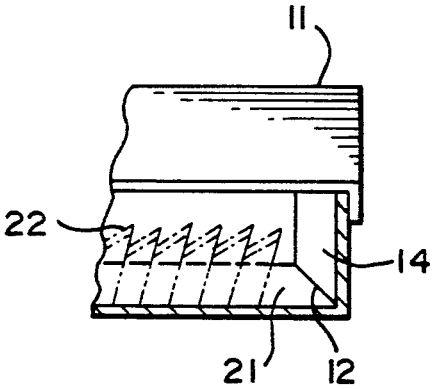
FIG. 6 is the front view of FIG. 5, showing the cutting motion by the cutting set.
Figure 5:
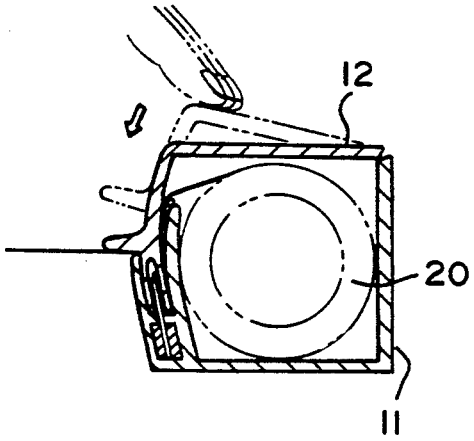
FIG. 5 is a cross-sectional view of the wrap film cutter of FIG. 1 at the time the lid is pressed to push the film.
Figure 7:
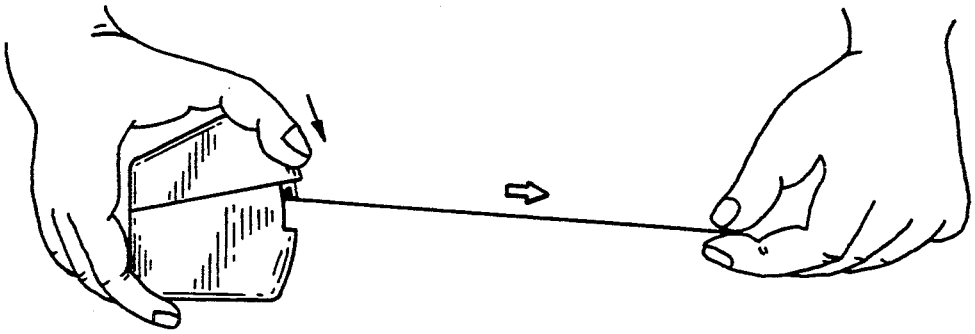
FIG. 7 showing an example of the use of the invention.

At least two springs are used to connect the rear edges of the housing 11 and lid 12 ( FIG. 2 only shows the spring 18 on one end, another end is not visible on the figure). By the elasticity of the springs the lid 12 can be opened and closed elastically so that the front edge of the cutter can form an open mouth 19. The wrap film 20 is loaded through the mouth 19 into the hollow portion of the housing 11 and the film cut motion will be completed by the opening and closing of the mouth 19.

The hidden cutting set 16 in the trough 15 on the front edge of the housing 11 comprises a base 21, a set of blades 23 embedded on the base 21 and, a spring 23. The base 21 is a little shorter than the trough 15 and the embedded set of blades 22 are aligned to form an indented cutting edge. The spring 23 sitting between the interior walls of the trough 15 withstands one end of the base 21 so that the base 21 can be moved lengthwise. The other end of the base 21 includes a declined plane 24. When the lid 12 is closed, the stuck out shaft 14 on the lid 12 will press onto the declined plane 24 of the base 21 and drive the base 21 together with the indented cutting edge to move toward the spring 23. Then the cutting motion of the hidden cutting set 16 is done.

The said front edge of the lid 12 has a double tiered protrusion 13, these protruding tiers form a downward opening. When the lid 12 is closed, the double tiered protrusion 13 will press on the film, and then the downward opening of the protrusion 13 is within the trough 15 of the front edge of the housing 11. Now the set of blades 22 stick into the downward opening deeply and the indented cutting edge pierces the film which is on the front of the downward opening. Meanwhile, the closing of the lid 12 causes the declined plane of the stuck out shaft 14 to press onto the declined plane 24 of the base 21 to drive the base 21 together with the blades toward another side. In this way the film can be cut quickly and smoothly through the sequential motions of piercing and cutting(as shown in FIGS. 3,4, 5 and 6).

To make the cutting more handy, it's necessary to add an accessory lifting bar 17 at the mouth 19 of the cutter. The lifting bar 17 is a latitudinal bar above the trough 15 with both ends appropriately curved and joined with springs 25 and 26 to be connected to the front edge of the housing 11. When the lid 12 is closed, it will push the lifting bar 17 downward, and after the cutting is completed and the lid 12 is released (the lid 12 bounces up by the elasticity of the springs 18 hence the front edge of the cutter forms a open mouth), the springs 25 and 26 on both ends of the lifting bar will force the lifting bar to a proper angle. In this way the film will be brought out of the mouth 19 by the lifting bar 17 for the convenience to the user drawing it again.

The present invention of wrap film cutter can be fixed on the wall for use. The user can just draw the film to the length needed, then press the lip 12 lightly with the fingers to have the film cut smoothly in a second. This invention of cutter can also be put on the plane surface or held by one hand and with another hand drawing the film. No matter in what way, a quick and smooth cutting by the length needed can always be easily achieved.

Figure 8:
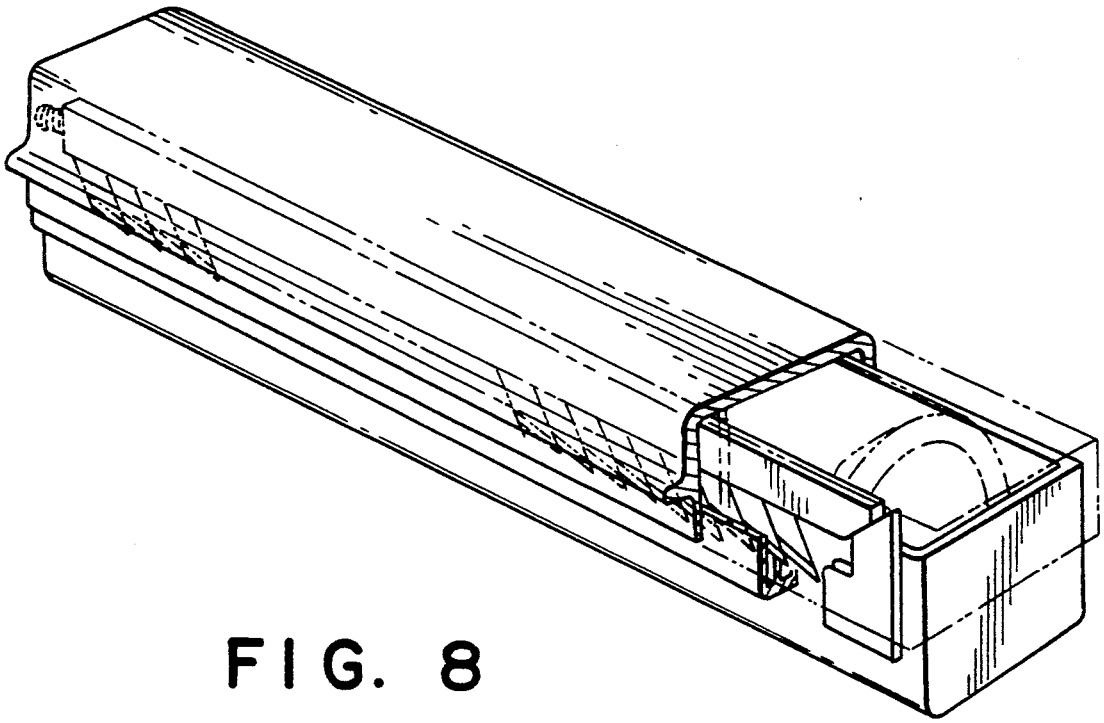
FIG. 8 is an another embodiment of the wrap film cutter of the present invention.
Figure 9:
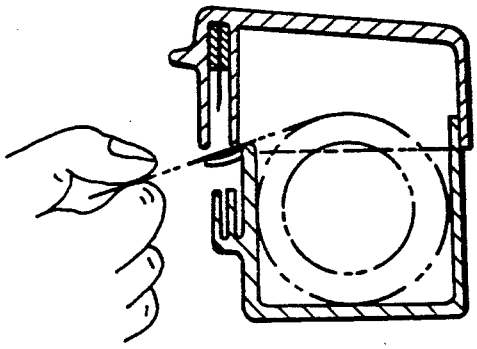
FIG. 9 is a cross-sectional view of the wrap film cutter of FIG. 8, in which the lid is not pressed yet.

FIGS. 8 and 9 showing another embodiment of the present invention. Wherein the hidden cutting set is installed in the trough of the front edge of the lid, the double tiered protrusion and the stuck out shaft that used for controlling the cutting motion are positioned on the front edge of the housing. As for the other installations like the springs that connect the lid to the housing and make the lid open and close elastically, the accessory lifting bar and the operation, the movement and the effect achieved, they are the same as the first embodiment.

Though the invention has been described herein according to preferred embodiments thereof, it shall be understood that various changes in shape, size, composition and arrangement of parts may be made by one of ordinary skill in the art without departing from the spirit of the invention or scope of the subjoined claims.

What is claimed is:

1. A wrap film cutter comprising:

an elongated housing having front and rear edges;

a trough located along the front edge of said housing;

an elongated lid having a front and a rear edge, the rear edge of said lid being pivotally secured to said housing;

biasing means interconnecting said housing and said lid, said biasing means tending to force said lid into an open position;

a double tiered protrusion extending from the front edge of said elongated lid toward said housing;

a shaft having a first end attached to said lid and a second end extending toward said trough, said second end of said shaft having a declined plane;

cutting means including an elongated base having first and second ends and an elongated cutting edge projecting toward said protrusion, said cutting means being slidably mounted within said trough, the first end of said base having a declined plane; and a spring positioned between said housing and the second end of said base, said wrap film cutter being adapted to receive a roll of wrapping film within said housing such that when a portion of such film is positioned between the front edges of said housing and said lid and said lid is closed, said double tiered protrusion presses the film portion into said trough to cause said cutting edge to pierce the film and said second end of said shaft engages said first end of said base to cause said cutting means to slide within said trough against the biasing force of said spring to thereby cut the film.

2. The wrap film cutter of claim 1, wherein said biasing means comprises a plurality of springs interconnected between said housing and said lid at spaced intervals along the rear edges thereof.

3. The wrap film cutter of claim 1, wherein said cutting edge includes a plurality of blades secured to said base.

4. The wrap film cutter of claim 1, further including an elongated lifting bar pivotally connected to said housing, said lifting bar being pivotable in response to engagement with said protrusion.

5. A wrap film cutter comprising:

an elongated housing having front and rear edges;

a double tiered protrusion located along the front edge of said housing;

an elongated lid having a front and a rear edge, the rear edge of said lid being pivotally secured to said housing;

biasing means interconnecting said housing and said lid, said biasing means tending to force said lid into an open position;

a trough located along the front edge of said lid;

a shaft having a first end attached to said protrusion and a second end extending toward said trough, the second end of said shaft having a declined plane;

cutting means including an elongated base having first and second ends and an elongated cutting edge projecting toward said protrusion, said cutting means being slidably mounted within said trough, the first end of said base having a declined plane; and a spring positioned between said lid and the second end of said base, said wrap film cutter being adapted to receive a roll of wrapping film within said housing such that when a portion of such film is positioned between the front edges of said housing and said lid is closed, said double tiered protrusion presses the film portion into said trough to cause said cutting edge to pierce the film and said second end of said shaft engages said first end of said base to cause said cutting means to slide within said trough against the biasing force of said spring to thereby cut the film.

6. The wrap film cutter of claim 5, wherein said biasing means comprises a plurality of springs interconnected between said housing and said lid at spaced intervals along the rear edges thereof.

7. The wrap film cutter of claim 5, wherein said cutting edge includes a plurality of blades secured to said base.

8. The wrap film cutter of claim 5, further including an elongated lifting bar pivotally connected to said housing, said lifting bar being pivotable in response to engagement with said protrusion.

* * * * *